United States Patent [19]

Raugust

[11] 3,949,821

[45] Apr. 13, 1976

[54] DRILL STRING JARRING AND BUMPING TOOL WITH PISTON DISCONNECT

[75] Inventor: Theodore Arthur Raugust, Calgary, Canada

[73] Assignee: Jarco Services Ltd., Calgary, Canada

[22] Filed: Mar. 3, 1975

[21] Appl. No.: 555,203

[52] U.S. Cl. ..... 175/297
[51] Int. Cl.[2] ..... E21B 1/10
[58] Field of Search ..... 175/297

[56] References Cited

UNITED STATES PATENTS

| | | | |
|---|---|---|---|
| 2,551,868 | 5/1951 | Brady | 175/297 |
| 2,659,576 | 11/1953 | Linney | 175/297 |
| 3,889,766 | 6/1975 | Sutliff et al. | 175/297 |

*Primary Examiner*—James A. Leppink
*Attorney, Agent, or Firm*—Rogers, Bereskin & Parr

[57] ABSTRACT

A jarring and bumping tool for a drill string is described. The tool includes an inner mandrel and an outer housing telescopically coupled together and defining therebetween an annular chamber for hydraulic fluid. A floating piston assembly is located in said chamber and is moved along in the chamber by a piston displacing device carried by the mandrel. A vertical strain applied to the mandrel when the tool is in use causes the said device to lift the piston assembly. The pressure of hydraulic fluid in the said chamber cushions movement of the mandrel until the piston assembly enters an enlarged portion of the hydraulic cylinder, whereupon the hydraulic pressure is released, allowing abutment faces on the mandrel and housing to slam together and apply an upward jar to the drill string. When the mandrel is returned downwardly, the piston displacing device draws the piston assembly down in the cylinder until movement of the assembly is arrested. Continued movement of the mandrel causes the device to disengage from the piston assembly, allowing other abutment faces on the mandrel and housing to slam together and apply a downward bump to the tool. Since the piston is disengaged and stationary during a bump, piston and cylinder wear is reduced, and fluid cushioning during a bump is also reduced.

9 Claims, 10 Drawing Figures

DRILL STRING JARRING AND BUMPING TOOL WITH PISTON DISCONNECT

Figure 1A:
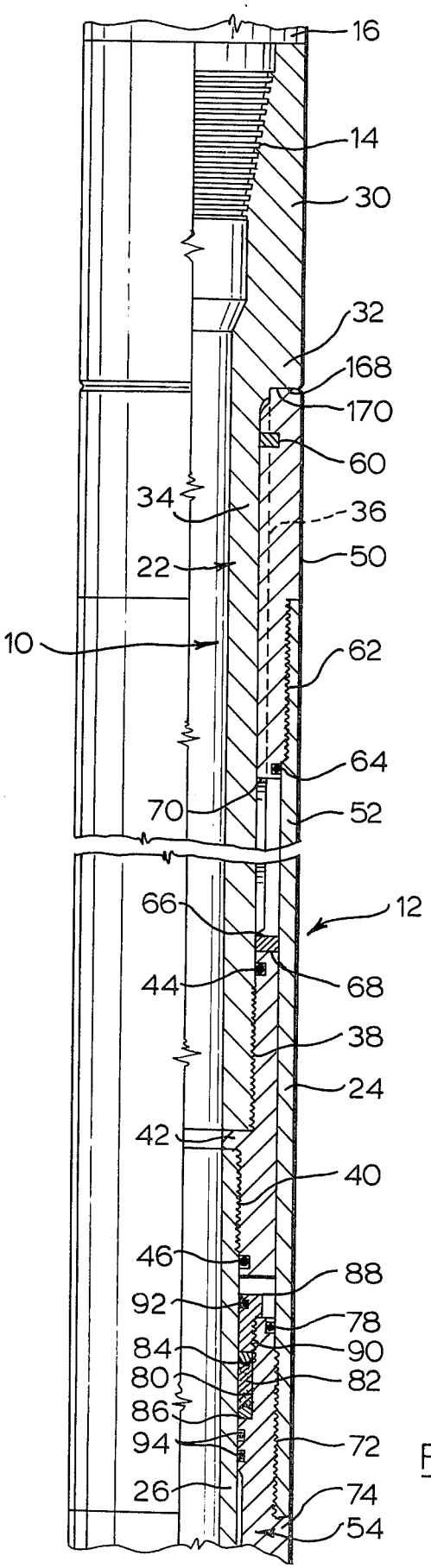

This invention is concerned generally with equipment for drilling oil wells, gas wells, and the like, and relates more particularly to a tool used to impart an upward jar or a downward bump to a drill string to assist in freeing a drill bit or other component stuck in a well bore.

Canadian Pat. No. 931,136 discloses a jarring and bumping tool for use in oil field drillings. The tool disclosed in the patent is hydraulic in operation and includes an inner mandrel and an outer barrel arranged to telescope relative to one another and defining a hydraulic cylinder therebetween. The bumping and jarring action of the tool is controlled by a valve located in the cylinder inside the tool and coupled to the mandrel. When the tool is operated, the mandrel is moved with respect to the barrel, causing the valve to move. Movement of the valve is restricted by the pressure of hydraulic fluid in the cylinder, which pressure is suddenly released, allowing impact faces on the mandrel and barrel to slam together. A disadvantage of this arrangement is that the valve must travel the complete length of the hydraulic cylinder each time the tool is operated, whether jarring or bumping. This requires that all of the hydraulic fluid in the cylinder must be displaced at each operation of the tool and results in cushioning of the impact of the tool by the fluid.

An object of the present invention is to provide an improved tool for imparting an upward jar or a downward bump to a drill string. Such tool comprises:

a mandrel adapted to be coupled at one end to a part of the drill string;

a tubular housing surrounding said mandrel and defining therewith an annular chamber for hydraulic fluid, said housing being adapted to be coupled at its end remote from said one end of the mandrel to another part of said drill string;

splined coupling means between the mandrel and the housing, said coupling means being adapted to allow relative longitudinal sliding movement of the mandrel and housing between an extended position of the tool and a closed position of the tool;

respective pairs of abutment faces on the mandrel and housing, defining said extended and closed positions of the tool;

a floating piston assembly of annular form positioned around the mandrel in said chamber and defining a first by-pass passageway through which fluid can by-pass the piston assembly when the passageway is open;

said chamber having a first section dimensioned to closely receive said piston assembly, a second section disposed adjacent one end of said first section and of greater inside diameter than said first section, and a third and elongated section disposed adjacent the other end of said first section;

stop means in the said annular chamber at said other end of said first section, said stop means being coupled to the tubular housing and defining a rest position for the piston assembly when the tool is closed;

a fluid flow control device in said piston assembly, said device providing a path for fluid to flow through the piston assembly at a restricted rate when said first by-pass passageway is closed;

displacing means coupled to said mandrel and located in said chamber adjacent the end of said third section remote from said first section when the tool is in closed position, said displacing means including contact means for contacting said piston assembly and for displacing said piston assembly from said stop means through said first section of said hydraulic chamber into said second section as said tool is extended;

co-operating means on the displacing means and piston assembly for sealing said first by-pass passageway against the flow of hydraulic fluid therethrough during relative movement of the mandrel and housing towards the extended position of the tool with said piston assembly in said first section of said hydraulic chamber;

whereby, in use, said relative movement causes the piston assembly to be displaced slowly along said first section of the hydraulic fluid chamber at a rate dependent on the rate of flow of hydraulic fluid through said control device, until the piston assembly enters said second section of the hydraulic fluid chamber, whereupon pressurized hydraulic fluid in said second section is released and flows past the piston assembly, allowing the relevant abutment faces of the mandrel and housing to slam together, applying an upward jar to the drill string; and, releaseable engaging means on the piston assembly and displacing means for coupling said assembly and displacing means during return movement of the mandrel and housing towards the closed position of the tool;

whereby said return movement of the mandrel and housing causes said displacing means to withdraw the piston assembly until movement of the assembly is arrested by said stop means, said engaging means then releasing and said displacing means moving out of engagement with the piston assembly and through said third section of said hydraulic chamber as closing movement of said tool continues;

said displacing means defining with the inner wall of said third section of said hydraulic chamber a second fluid by-pass passageway of substantial size, to permit fluid rapidly to by-pass around said displacing means as said displacing means moves through said third section, whereby the other faces of said mandrel and housing may slam together to apply a downward bump to the drill string as closing movement of said tool continues.

Figure 2A:
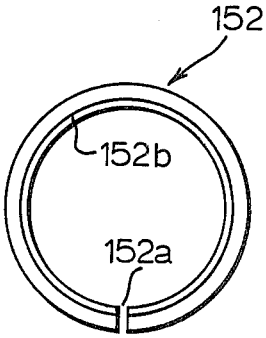
Figure 1B:
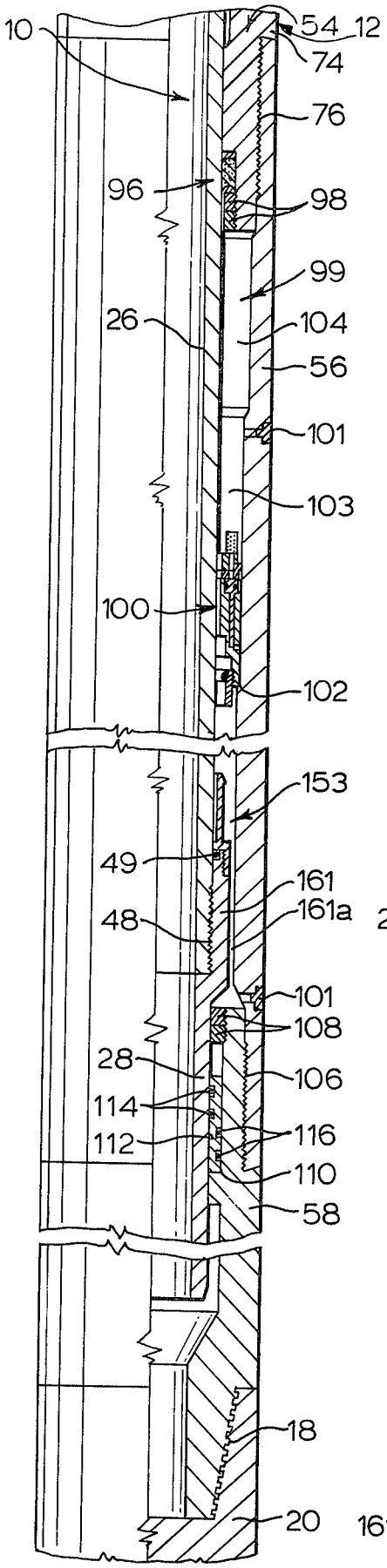
Figure 2:
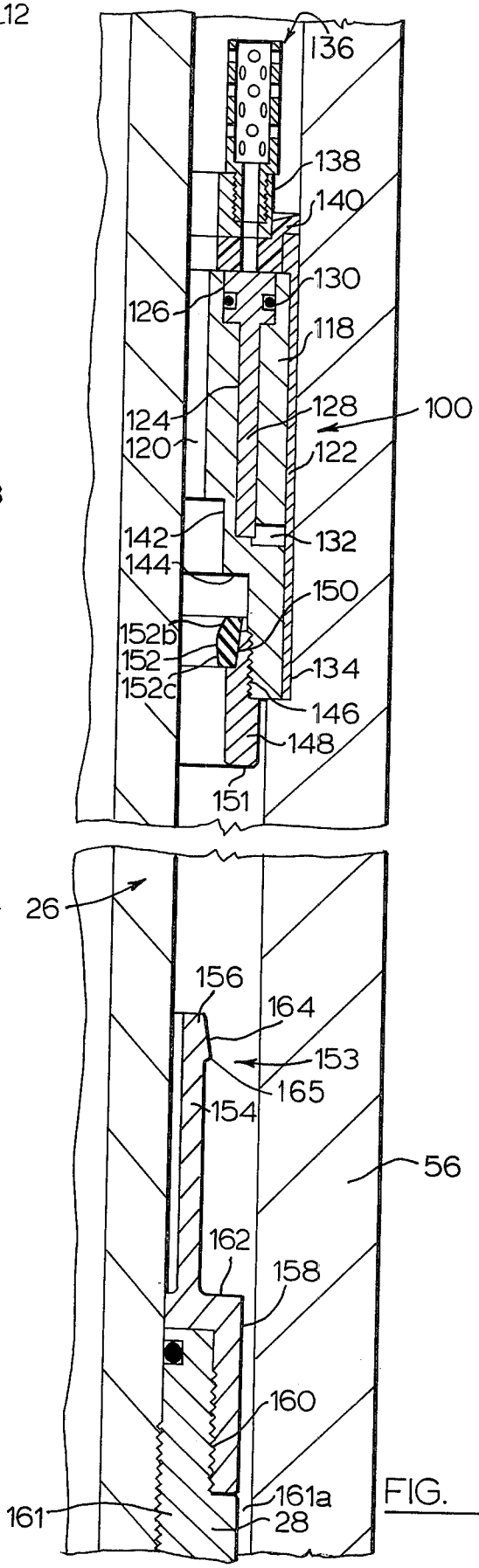

A preferred embodiment of the invention will now be described by way of example with reference to the accompanying drawings, in which:

FIG. 1*a* and 1*b* are side views of the upper and lower sections respectively of a tool according to the invention in the bump (closed) position, the views being partly sectioned to show the internal structure of the tool;

FIG. 2 is an enlarged view of part of FIG. 1*b;*

Figure 3B:
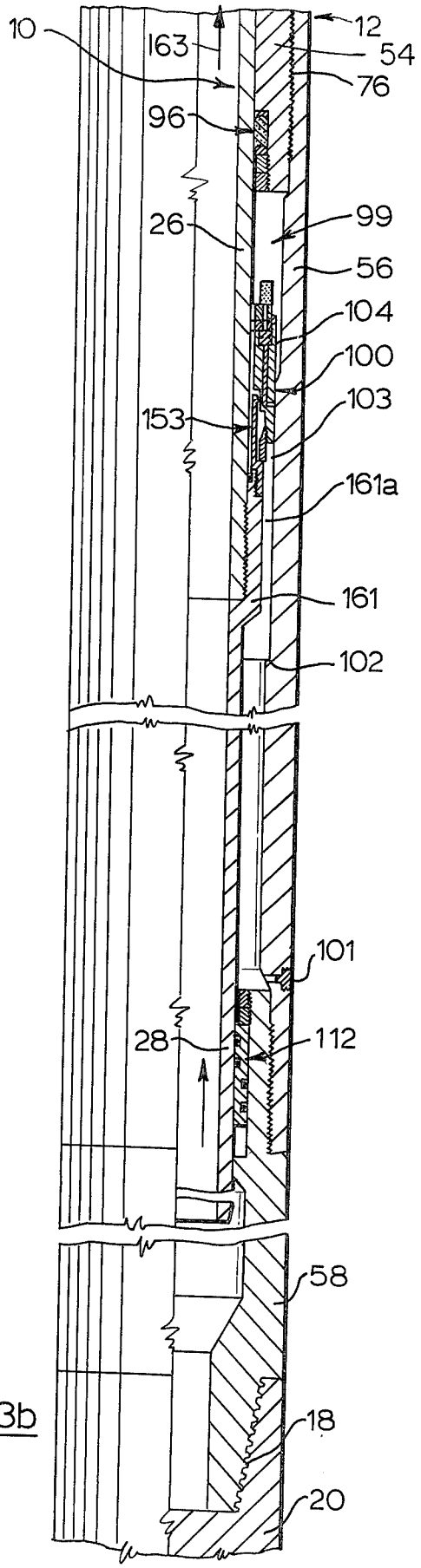
Figure 4:
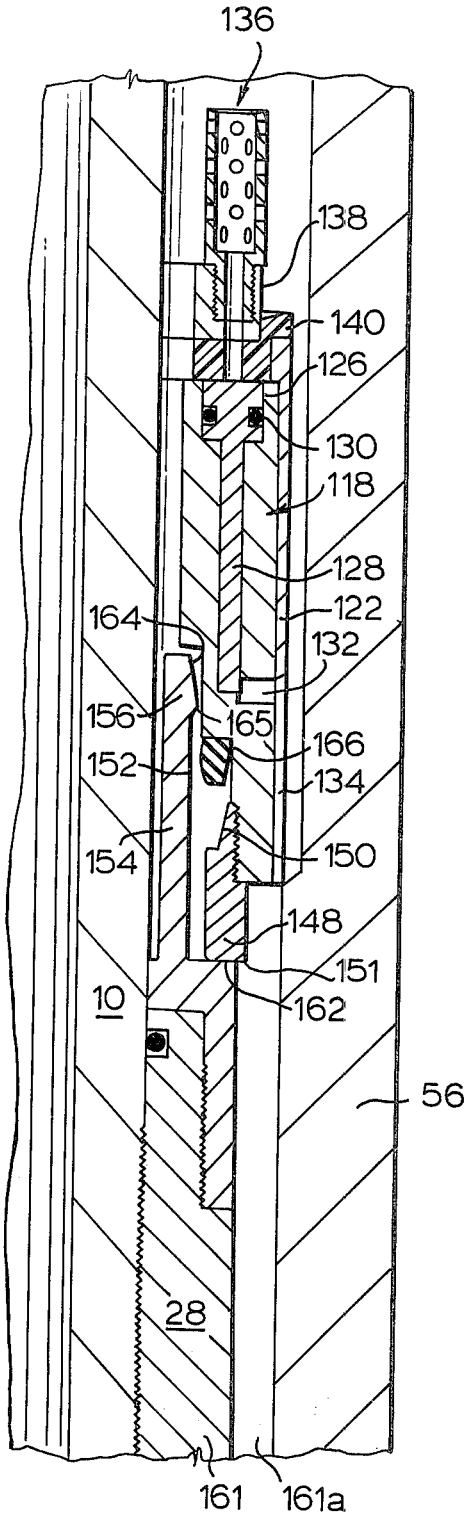
Figure 3A:
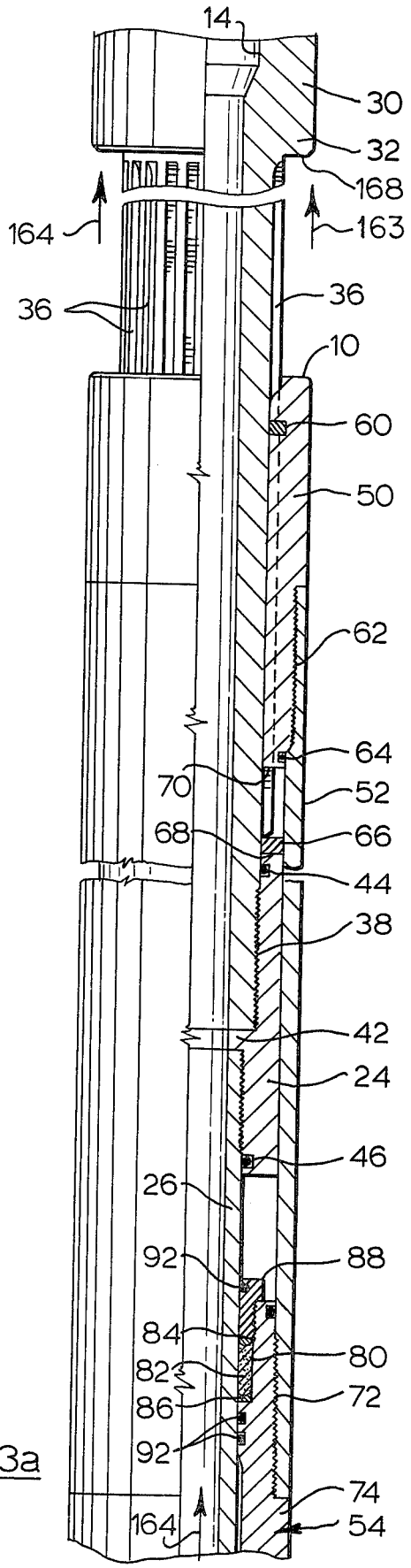

FIG. 2*a* is a top view of a friction ring used in the tool of FIG. 1;

FIGS. 3*a* and 3*b* are views similar to FIGS. 1*a* and 1*b* showing the tool intermediate the bump position of FIGS. 1*a* and 1*b*, and the jar (extended) position;

FIG. 4 is an enlarged view of part of FIG. 3*b;*

Figure 5:
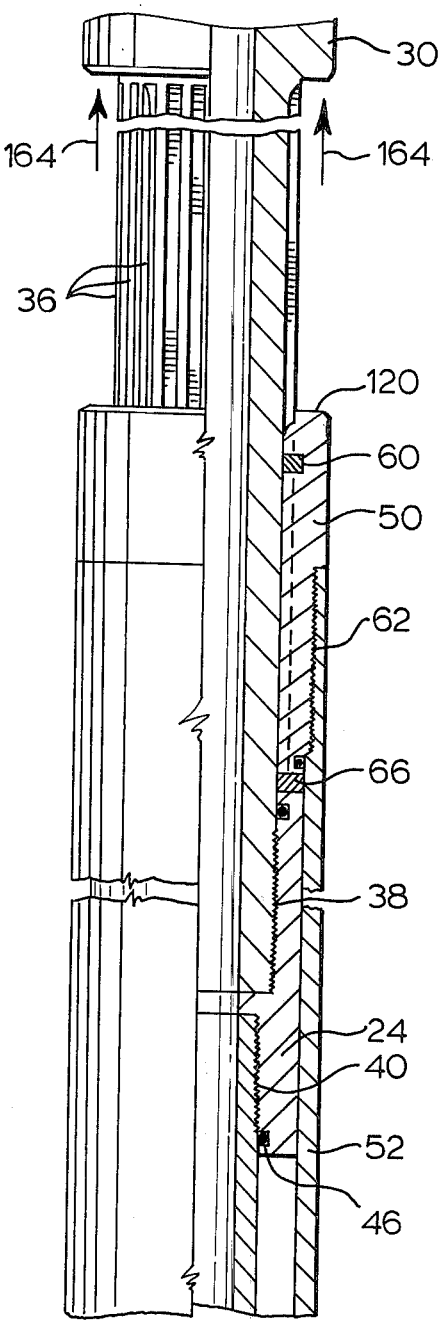
Figure 7:
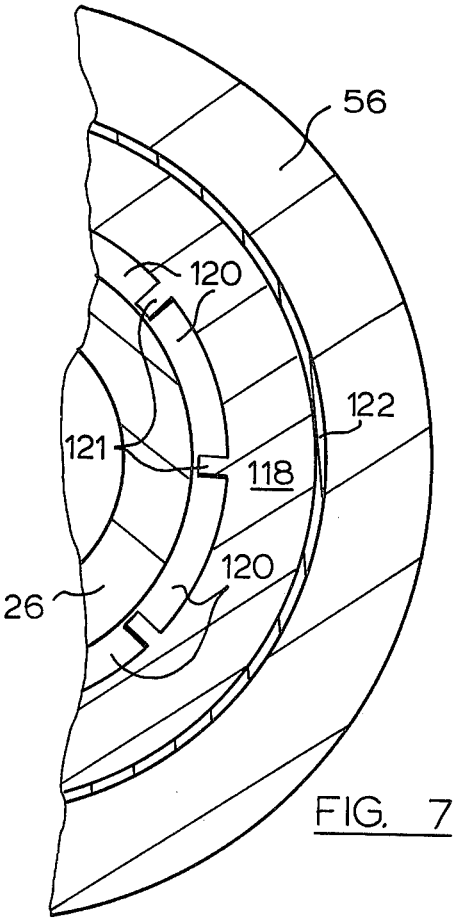
Figure 6:
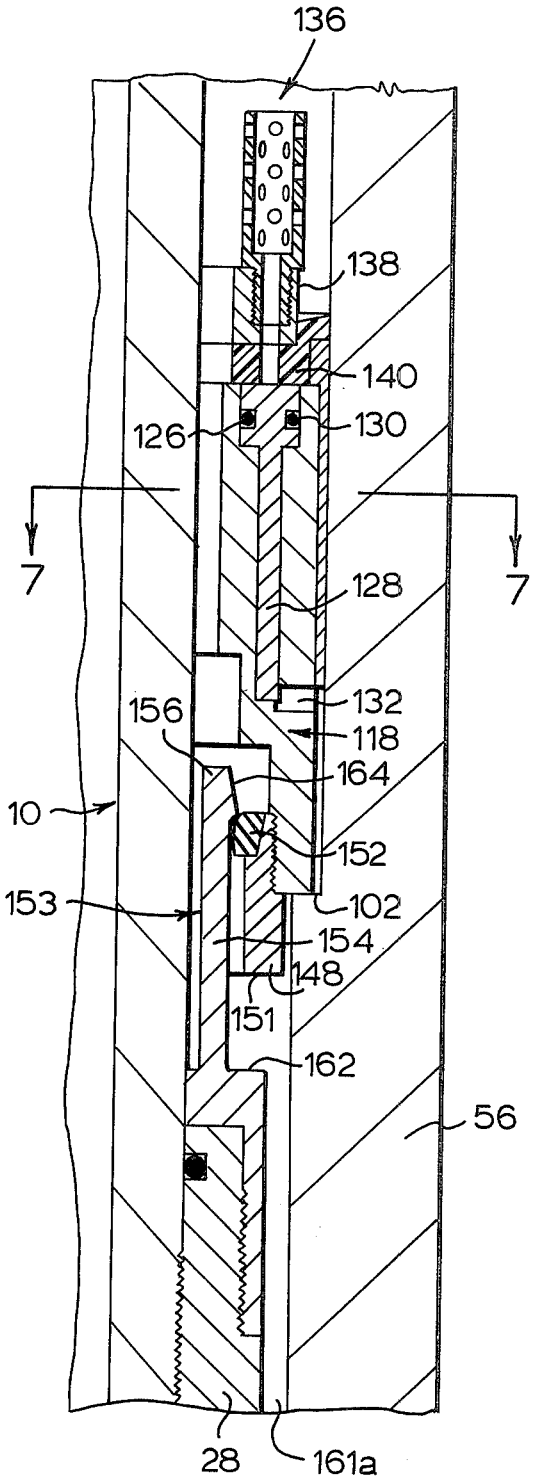

FIG. 5 corresponds to part of FIG. 3*a* and shows the parts of the tool in the jar position;

FIG. 6 is a view similar to FIGS. 2 and 4, showing the parts of the tool in the positions they occupy just before reaching the bump position; and, FIG. 7 is a transverse cross-sectional view on line VII—VII of FIG. 6.

Referring first to FIGS. 1*a* and 1*b*, the tool is made up of two sub-assemblies which are telescopically slidable with respect to one another and which are formed by an inner mandrel 10 and an outer housing 12. Mandrel 10 is formed at its upper end with an internally screwthreaded socket 14 of tapered form by which the tool is attached to an upper part 16 (FIG. 1*a*) of the drill string of a drilling installation. The outer housing 12 is formed at its lower end with an externally screwthreaded formation 18 which is tapered and by which the tool is connected to a lower part 20 (FIG. 1*b*) of the drill string.

The inner mandrel 10 is assembled from four hollow cylindrical sections denoted respectively 22, 24, 26 and 28, which are screw-threaded together. Section 22 includes a head portion 30 of enlarged diameter which defines a shoulder 32 against which the upper end of the outer housing 12 of the tool rests when in the bump position. The smaller diameter portion 34 of section 22 is formed with a series of longitudinally-extending external splines 36 which are spaced around the section. These splines are exposed in FIG. 3*a* and 5.

Section 24 of the inner mandrel 10 is referred to as a "knocker". The upper portion of section 24 surrounds the lower end portion of the section 22 and the two sections are coupled together by co-operating screw threads 38 on the respective sections. Similarly, the lower end portion of the knocker 24 extends around the upper end portion of mandrel section 26 and the two sections are coupled together by co-operating screw threads indicated at 40. An inwardly directed rib 42 on the knocker 24 is disposed between the lower end of section 22 and the upper end of section 26. Sealing rings 44 and 46 are fitted into internal annular grooves in the knocker section 24 to seal the screw threads 38 and 40 against leakage of the drilling fluid used in the tool as will be described. At its lower end, section 26 is connected by screw threads 48 to the bottom section 28 of the inner mandrel 10. A sealing ring 49 similar to the rings 44 and 46 is provided to guard against leakage through the threads 48.

The outer housing sub-assembly 12 is made up of five hollow cylindrical sections denoted 50, 52, 54, 56 and 58 which are connected together by screw threads in similar fashion to the sections of the inner mandrel. The uppermost section 50 forms a housing for the splines 36 on section 22 of the inner mandrel. Section 50 is formed with a series of axially extending keyways which receive the splines 36, whereby the inner mandrel 10 and the outer housing 12 are prevented from turning relative to one another but can slide telescopically. A wiper ring 60 is received in an inwardly directed annular groove disposed adjacent the top of the spline housing 50. Ring 60 is moulded in a polyurethane material to fit the splines 36 with close tolerance so that as the mandrel and housing telescope relative to one another in use, the ring wipes over the splines and prevents debris from entering between the splines and keyways and possibly causing excessive wear and even jamming of the splines.

Section 52 of the outer housing 12 is connected to the upper section 50 by screw threads 62. A sealing ring 64 similar to the rings referred to above is provided in an external annular groove adjacent the lower end of the spline housing 50. Section 52 of the outer housing 12 is referred to as the knocker housing, since it extends around the knocker 24 of the inner mandrel 10. A free-floating annular impact ring 66 rests on the upper end face 68 of the knocker 24 of the inner mandrel 10 and is positioned to hit against the lower end face 60 of the spline housing 50 when the tool is used to apply a jar to a drill string in use. The impact ring 66 is made of softer steel than the knocker 24 and spline housing 50 so as to minimize the risk of damage to the faces 68 and 70 when the tool is in use. In other words, the impact ring 66 distorts under impact, rather than damaging the said faces.

Section 54 of the outer housing 12 is connected to the knocker housing 52 by screw threads 72. The section has a portion 74 which projects below the lower end of the knocker housing 52 and above the upper end of the adjacant section 56, to which it is connected by threads 76 (FIG. 1*b*). Referring back to FIG. 1*a*, section 54 is provided adjacent its upper end with an outwardly directed annular groove which receives a sealing ring 78. At its inner surface the section is formed with an annular recess 80 which receives a packing gland 82 retained by an upper male junk ring 84 and a lower female junk ring 86. The assembly of gland 82 and rings 84 and 86 are retained by a gland nut 88 screwed into a threaded hole 90 in the section. A mandrel wiper ring 92 extends around the inner mandrel section 26 and is located in a groove adjacent the upper end of the gland nut. Two sealing rings 94 are positioned below the packing gland 82. The mandrel wiper ring 92 is moulded in a polyurethane material and serves to wipe abrasive material off the mandrel as the tool operates in use to protect the packing gland against damage. A similar assembly of a packing gland and junk rings is provided inside the lower end of section 54 and is generally denoted 96. This assembly is retained by two nuts 98 screwed into the bottom end of the packing member.

The outer housing section 56 extends around the inner mandrel section 26 and defines therewith an annular hydraulic cylinder 99. A piston assembly generally denoted 100 is located in the cylinder and will be described later. Plugs 101 are provided in the wall of section 56 for the purpose of filling the cylinder with hydraulic fluid. A suitable fluid is that sold under the trademark SILICONE 200. This fluid exhibits small changes in viscosity over a large temperature range.

The outer housing section 56 is shaped to define a hydraulic cylinder having a shoulder 102 against which the piston assembly 100 abuts when in its rest position. Also, the cylinder is stepped to define a first portion 103 shaped to closely receive said assembly, and a second portion 104 of substantially greater width than portion 103. The purpose of this stepped cylinder configuration will become apparent later.

The lower end section 58 of the outer housing 12 is coupled to section 56 by screw threads indicated at 106. It is the lower end of this section which is formed with the external screw threads indicated at 18 and referred to above. Two gland nuts 108 are screwed inside the upper end of the section. Below the gland nuts the section is formed with a recess 110 which receives a sleeve 112 having annular grooves housing two sets of sealing rings 114 and 116 arranged, in effect, to seal the lower end of the hydraulic cylinder referred to above.

Reference will now be made to FIG. 2 in describing the piston assembly 100 referred to above. The assembly includes a piston body in the form of a sleeve 118 which fits around section 26 of the inner mandrel. The sleeve is spaced from the outer surface of the said section and is provided with a plurality of axially grooves 120 defining ribs 121 (FIG. 7) which run on said surface of mandrel section 26. The grooves 120 form by-pass passageways through which hydraulic fluid can flow through the piston body. Piston body 118 is made of steel and is provided with a brass overlay 122 forming a bearing surface with the inner surface of the outer housing section 56.

A cylindrical bore 128 extends through the piston body 118 and has an enlarged upper end 126. A cartridge 128 of porous brass is received in the bore 124, 126 and serves to restrict the flow of hydraulic fluid through the piston when the tool is in use and the by-pass passageways 120 are closed as will be described. The porous brass from which the cartridge is made is temperature sensitive so that, at a high temperature, the porosity of the cartridge is reduced to compensate for reduced viscosity of the hydraulic fluid. A sealing ring 130 extends around the cartridge at the enlarged upper end 126 of the bore to prevent hydraulic fluid flowing between the cartridge and the wall of the bore. The lower end of the bore communicates with the portion of the hydraulic cylinder below the piston assembly by way of a transverse port 132 which extends to the outer surface of the piston and which communicates with a longitudinal groove 134 in the brass overlay of the piston.

The upper end of the bore 124, 126 communicates with the portion of the hydraulic cylinder above the piston assembly by way of an external filter 136 which is screwed into a plate 138 coupled to the upper face of the piston 118 by bolts (not shown). A cup 140 of TEFLON (Registered Trade Mark) is fitted between the plate 138 and the piston body 118. The plate 138 accordingly retains both the cup 140 and the valve cartridge 128.

The lower end of the piston body 118 is formed with two stepped recesses 142 and 144 and is formed at its lower end with an internal screw thread 146 with which a nut 148 is engaged. The nut has a tapered upper face 150 which forms a seat for a friction ring 152 (FIG. 2*a*) and a flat annular face 151 at its lower end, the purpose of which will become apparent later. The ring 152 contains a split **152*a* so that the ring can be expanded, as will be described. In the condition shown in FIG. 2, the friction ring 152 rests under gravity on the seat 150 in an expanded condition and in effect forms a continuous ring. The inner wall of the ring 152 contains a short steep upper taper 152*b*** (FIG. 2*a*) and a lower long and more gradual taper **152*c***, for a purpose to be described.

Secured to the upper end of the lower section 28 of the inner mandrel 10 is a device 153 for displacing the piston assembly along the hydraulic fluid chamber 99. The device 153 includes an annular series of resilient steel fingers 154 (FIG. 2), each of which extends parallel to and is spaced from section 26 of the inner mandrel. There are twelve fingers spaced around the mandrel. Each finger has an upwardly tapered formation 156 at its upper end. The fingers 154 are coupled to the mandrel by an integral collar 158 which is connected by screw threads 160 to an enlarged diameter upper portion 161 of the mandrel section 28. Collar 158 has a flat annular face 162 arranged to abut and seal with the face 151 at the lower end of the piston assembly 100 as will be described. A substantial clearance **161*a* is provided between the mandrel section 161 and the wall of section 56 encircling mandrel section 161.**

The tool operates as follows, starting from the down position as shown in FIGS. **1*a*, 1*b* and 2. To apply a jar to the drill string in which the tool is fitted, a vertical strain is applied to the inner mandrel by drawing the drill string upwardly. If the outer housing 12 is restrained due, for example, to the drill bit being wedged in the well bore, the inner mandrel will initially move upwardly with respect to the housing, as indicated by the arrows 163 in FIGS. 3*a* and 3*b*. The head portion 30 of the inner mandrel will lift off the upper section 50 of the outer housing (FIG. 3*a*) exposing the splines 36. The hydraulic cylinder 99 of the tool is full of hydraulic fluid at this time. The upward movement of the inner mandrel causes the fingers 154 on the lower section 28 of the mandrel to move upwardly. Hydraulic fluid is displaced from above to below the enlarged piston displacing device 153 at this time, through the large clearance 161*a*. Because of the substantial size of the clearance 161*a*, the hydraulic fluid can flow through this clearance readily, and there is relatively low resistance to the upward movement of the mandrel at this time. The piston assembly 100** remains stationary at this time.

As the inner mandrel continues to move upwardly, the tapered upper ends of the fingers 154 eventually enter the nut 148 at the lower end of the piston assembly and engage the friction ring 152 with a very slight interference (typically about 0.100 inches). Continued upward movement of fingers 154 displaces the friction ring 152 upwardly to the top of the recess 144 (FIG. 4). Then, as the fingers 144 continue their upward movement, the ring 152 spreads slightly, as permitted by the split **152*a*. The spreading movement is limited by the walls of recess 144 but is sufficient to allow the fingers to pass through the ring 152, until the upper face 162 of collar 158 contacts the face 151 at the lower end of the piston assembly. Because the ring 152, although of steel, is quite thin (typically about 4 inches in inside diameter, and about three-eighths inches in height and width), and because of the long taper 164 at the tops of the fingers which engages the long taper 152*c* at the bottom of the ring, the ring 152 readily spreads as the fingers move through it, and the fingers 156 do not lift the piston assembly at this time. After the fingers 156 have passed through the ring 152, the ring contracts again and normally falls back to its seat 150.**

The abutting faces 151, 162 now effectively seal the by-pass passageways 120 and prevent hydraulic fluid flowing through the piston assembly. FIG. 4 shows the piston release 153 and the piston assembly 100 in this position and it will be noted that the parts of the friction ring 152 are at this time in contact with the upper surface 166 of the lower recess 144 in the piston 118.

As the inner mandrel continues to move upwardly, the face 162 of the piston displacing device 153 causes the piston assembly to move upwardly and lift off the shoulder 102. Since hydraulic fluid cannot flow past the piston by way of passageways 120, the only route for the fluid is through the filter 136, the valve cartridge 128 and out through port 132 and groove 134 into the lower portion of the cylinder. Accordingly, the hydraulic fluid above the piston will be under compression and will provide considerable resistance to continued vertical movement of the inner mandrel. The mandrel will therefore rise at an extremely slow speed up the first portion 103 of the cylinder. As soon as the lower end of the piston 118 passes the step between the first portion 103 and the second, wider portion 104 of the cylinder, the pressurized hydraulic fluid above the piston is dumped around the piston, drastically reducing the resistance of the fluid to upward movement of the mandrel and causing the impact ring 66 on the knocker 24 to slam against the lower surface 70 of section 50 of the outer housing. The jarring effect of this impact is transmitted through the outer housing 12 to the bottom section 20 of the drill string. FIG. 5 shows the positions of the components at the upper portion of the tool at this time.

To apply a "bump" shock to the tool from the position shown in FIG. 5, the inner mandrel is moved downwardly from the FIG. 5 position. The formations 156 (FIG. 4) at the upper ends of fingers 154 engage the friction ring 152 of the piston assembly and move the ring 152 down into engagement with the tapered surface 150 of nut 148 of the piston assembly, if the ring is not already in that position. Because the short steep taper 165 at the bottom of formations 156 engages the short steep taper 152*b* at the top of the ring 152, the ring does not spread as it is being drawn onto its seat 150, and of course once the ring 152 is seated on seat 150, it cannot spread. FIG. 6 shows the ring 152 back on the seat 150.

Continued downward movement of the inner mandrel causes the piston assembly to be drawn down by the fingers 154. As the piston assembly moves down, hydraulic oil in the lower part of the cylinder passes through the gaps between the fingers 154 and through the by-pass passageways 120 of the piston assembly into the upper end of the hydraulic cylinder. In addition, some fluid will flow upwardly through the filter 136 of the piston assembly, flushing the filter and removing debris therefrom. Relatively free downward movement of the piston assembly continues until the piston 118 engages the shoulder 102 in the hydraulic cylinder. As the inner mandrel continues to descend, the friction ring 152 of the piston assembly is forced under increasing pressure against the tapered face 150 on the nut 148 until the fingers 154 (which are quite stiff) deflect inwardly, freeing themselves from the ring. The inner mandrel, with the piston displacing device 153 thereon, is now free to descend rapidly until the lower face 168 of the head portion 30 of the inner mandrel is brought into jarring impact with the upper face 170 of the upper section 50 of the outer housing. The shock of this impact is transmitted to the lower section of the drill string through the outer housing. The energy stored in the drill string as the fingers 154 are being deflected inwardly adds to the force of the bump.

It will be seen that the need has been eliminated for the piston assembly 100 to travel the complete distance required to effect a bumping action (since the assembly 100 is disengaged at shoulder 102). This reduces piston and cylinder wear, since these parts do not participate in the bumping action. In addition, after the piston assembly 100 is disengaged during closing of the tool for a bump, the largest part travelling through the lower part of housing 56 is the upper portion 161 of the mandrel and the collar 158 thereon. Since these parts are of smaller diameter than that of piston assembly 100, the clearance 161*a* can be made to have a very substantial cross-sectional area. This reduces the fluid cushioning which tends to restrict the intensity of a bump.

Normally, the tool will operate satisfactorily to apply a bump to the drill string if the mandrel is simply allowed to fall. The weight of the part of the drill string above the tool will provide sufficient force to operate the tool. If necessary, the mandrel can, of course, be positively displaced downwardly.

If desired, for bumping action the inner mandrel can be raised only until the piston displacing device 153 has begun to lift the piston assembly 100, and then downward movement of the drill string can be initiated.

The tool described above may be used as a normal part of a drill string and has the advantage that it can be used either in its extended condition or in its closed condition during normal drilling. In other cases, a fishing tool or the like may be attached to the lower end of the tool and the tool used as part of equipment for retrieving a broken drill bit or other component stuck in a well bore. A further significant advantage of the tool is that the intensity of the jar or bump imparted to the drill string when the tool is operated can be varied by varying the rate at which the inner mandrel is moved to operate the tool. Also, it is possible to close the tool without applying a bump thereto by lowering the mandrel at a controlled slow rate.

It is, of course, to be understood that the preceding description applies to a specific embodiment of the invention only and that many modifications are possible within its broad scope. For example, although the valve cartridge has been described as being of porous brass, other materials may be used. For example, porous bronze is another possibility.

It will be appreciated that although the means for displacing the piston assembly (such means being face 162 of collar 158 which engages face 151 at the lower end of the piston assembly) and the means for sealing the by-pass passageways 120 are one and the same, separate means can be used for sealing and for pushing. However, the arrangement shown is simple and is preferred.

In addition, although the split friction ring 151 and fingers 154 constitute a simple and effective way of providing disengagement between the piston assembly 100 and the mandrel (thus reducing the shock loads on the piston assembly during bumping), other well known mechanical releases can be used if desired.

What I claim is:

1. A tool for imparting an upward jar or a downward bump to a drill string, the tool comprising:

a mandrel adapted to be coupled at one end to a part of the drill string;

a tubular housing surrounding said mandrel and defining therewith an annular chamber for hydraulic fluid, said housing being adapted to be coupled at its end remote from said one end of the mandrel to another part of said drill string;

splined coupling means between the mandrel and the housing, said coupling means being adapted to allow relative longitudinal sliding movement of the mandrel and housing between an extended position of the tool and a closed position of the tool;

respective pairs of abutment faces on the mandrel and housing, defining said extended and closed positions of the tool;

a floating piston assembly of annular form positioned around the mandrel in said chamber and defining a first by-pass passageway through which fluid can by-pass the piston assembly when the passageway is open;

said chamber having a first section dimensioned to closely receive said piston assembly, a second section disposed adjacent one end of said first section and of greater inside diameter than said first section, and a third and elongated section disposed adjacent the other end of said first section;

stop means in the said annular chamber at said other end of said first section, said stop means being coupled to the tubular housing and defining a rest position for the piston assembly when the tool is closed;

a fluid flow control device in said piston assembly, said device providing a path for fluid to flow through the piston assembly at a restricted rate when said first by-pass passageway is closed;

displacing means coupled to said mandrel and located in said chamber adjacent the end of said third section remote from said first section when the tool is in closed position, said displacing means including contact means for contacting said piston assembly and for displacing said piston assembly from said stop means through said first section of said hydraulic chamber into said second section as said tool is extended;

co-operating means on the displacing means and piston assembly for sealing said first by-pass passageway against the flow of hydraulic fluid therethrough during relative movement of the mandrel and housing towards the extended position of the tool with said piston assembly in said first section of said hydraulic chamber;

whereby, in use, said relative movement causes the piston assembly to be displaced slowly along said first section of the hydraulic fluid chamber at a rate dependent on the rate of flow of hydraulic fluid through said control device, until the piston assembly enters said second section of the hydraulic fluid chamber, whereupon pressurized hydraulic fluid in said second section is released and flows past the piston assembly, allowing the relevant abutment faces of the mandrel and housing to slam together, applying an upward jar to the drill string; and, releaseable engaging means on the piston assembly and displacing means for coupling said assembly and displacing means during return movement of the mandrel and housing towards the closed position of the tool;

whereby said return movement of the mandrel and housing causes said displacing means to withdraw the piston assembly until movement of the assembly is arrested by said stop means, said engaging means then releasing and said displacing means moving out of engagement with the piston assembly and through said third section of said hydraulic chamber as closing movement of said tool continues;

said displacing means defining with the inner wall of said third section of said hydraulic chamber or second fluid by-pass passageway of substantial size, to permit fluid rapidly to by-pass around said displacing means as said displacing means moves through said third section, whereby the other faces of said mandrel and housing may slam together to apply a downward bump to the drill string as closing movement of said tool continues.

2. A tool as claimed in claim 1, wherein said co-operating means for sealing the first by-pass passageway and said contact means together include an annular sealing face at the end of the piston assembly adjacent said stop means, said face encircling said first by-pass passageway, and an annular shoulder on said displacing means, said shoulder being positioned to push against said annular face of the piston assembly simultaneously to push said piston assembly through said first section and to seal said by-pass passageway during relative movement of the mandrel and housing towards the extended position of the tool in use.

3. A tool as claimed in claim 2, wherein the piston assembly is formed at its end adjacent said stop means with an annular recess surrounding the inner mandrel of the tool, the said annular sealing face encircling the outer end of said recess, and wherein said releaseable engaging means includes: an annular friction ring located in said recess and having a split therein permitting spreading of said ring, an annular seat formed inside said recess for locating the friction ring, and for preventing spreading of said ring when said ring is located on said seat, said ring being freely moveable off said seat in a direction away from said displacing means, such movement of said ring and the spreading of said ring being limited by the walls of said recess, a plurality of spaced resilient fingers connected to said displacing means for movement through said friction ring into said recess as said tool is extended, said fingers having a very slignt interference with said ring when said ring is on said seat, said fingers and said ring having cooperating surfaces for said fingers to spread said ring and pass therethrough as said fingers move through said first section toward said second section, said fingers including means for engaging said ring to return it to said seat at the commencement of the return movement of the mandrel and housing to the closed position of the tool and for holding said ring against said seat until the piston assembly reaches said stop means, said fingers then being inwardly deflected upon continued closing of said tool, thus permitting disengagement of said fingers from said ring and permitting movement of said displacing means through said third section.

4. A tool as claimed in claim 3, wherein said mandrel includes an annular collar fitted thereto and defining the annular shoulder of the displacing means, said fingers being integral with said collar.

5. A tool as claimed in claim 1, wherein the piston assembly includes a piston body of annular form which slides on the mandrel, and wherein a plurality of first by-pass passageways are formed between the mandrel and the piston body.

6. A tool as claimed in claim 1, wherein the mandrel and housing are each made up of a plurality of tubular sections screw-threaded together, the mandrel including a head section having a shoulder against which the upper section of the housing abuts when the tool is in the closed position, the abutting faces of said shoulder and section forming said faces defining the closed position of the tool, and wherein one of the other sections of the mandrel defines a knocker having an upper annular face disposed transverse to the axis of the tool and arranged to abut an opposing face at the lower end of the section of said tubular housing, the abutting faces of said knocker and housing section forming said faces defining the extended position of the tool.

7. A tool as claimed in claim 6, further comprising an impact ring of softer material than the material of said sections freely located on said upper annular face of the knocker section of the mandrel.

8. A tool as claimed in claim 1, wherein the said fluid flow control device of the piston assembly is in the form of a porous cartridge fitted into a bore in the assembly and communicating at its opposite ends with said hydraulic fluid chamber.

9. A tool as claimed in claim 2, wherein the piston assembly includes a hydraulic fluid filter positioned at the end of said bore remote from said means for displacing the piston assembly, the filter serving to filter hydraulic fluid entering the cartridge as the tool moves from said closed position to said extended position.

* * * * *